US011015393B2

(12) United States Patent
Mohon et al.

(10) Patent No.: US 11,015,393 B2
(45) Date of Patent: May 25, 2021

(54) VALVE MECHANISM FOR ROTARY STEERABLE TOOL AND METHODS OF USE

(71) Applicant: Halliburton Energy Services, Inc., Houston, TX (US)

(72) Inventors: Brian Allen Mohon, Spring, TX (US); Robert Eric Epstein, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 204 days.

(21) Appl. No.: 16/305,726

(22) PCT Filed: Jul. 21, 2016

(86) PCT No.: PCT/US2016/043278
§ 371 (c)(1),
(2) Date: Nov. 29, 2018

(87) PCT Pub. No.: WO2018/017092
PCT Pub. Date: Jan. 25, 2018

(65) Prior Publication Data

US 2020/0040658 A1 Feb. 6, 2020

(51) Int. Cl.
*E21B 7/04* (2006.01)
*E21B 7/06* (2006.01)
*E21B 34/16* (2006.01)

(52) U.S. Cl.
CPC ..... *E21B 7/062* (2013.01); *E21B 7/04* (2013.01); *E21B 34/16* (2013.01); *E21B 7/046* (2013.01)

(58) Field of Classification Search
CPC ..... E21B 7/062; E21B 7/046; E21B 34/16; E21B 7/06; E21B 7/064; E21B 7/04;
(Continued)

(56) References Cited

U.S. PATENT DOCUMENTS 6,116,354 A 9/2000 Buytaert
8,763,725 B2 * 7/2014 Downton ..... E04D 13/1681 175/73

(Continued)

FOREIGN PATENT DOCUMENTS

WO 2014/036643 A1 3/2014

OTHER PUBLICATIONS

International Search Report and Written Opinion issued in related PCT Application No. PCT/US2016/043278 dated Mar. 20, 2017, 16 pages.

*Primary Examiner* — Yong-Suk (Philip) Ro
(74) *Attorney, Agent, or Firm* — Benjamin Ford; Baker Botts L.L.P.

(57) ABSTRACT

The present disclosure includes systems and methods for steering a rotary drilling tool used in subterranean drilling operations. The methods of the present disclosure may be suitable for steering a drilling tool comprising rotating a drill string coupled to a drill bit about its axis to form a wellbore; controlling a rotary motor disposed within the drill string to selectively open and close one or more of a plurality of gate valves to hydraulically actuate a corresponding one or more plurality of steering pads by, in an open position, allowing pressurized fluid to contact corresponding interior surfaces of the corresponding one or more plurality of steering pads to push the one or more plurality of steering pads into contact with a portion of the wellbore to deflect the drill bit away from the portion of the wellbore. The movable steering pads may be selectively extended so as to contact the portion of the wellbore at the same relative rotational position as the tool rotates.

20 Claims, 4 Drawing Sheets

(58) Field of Classification Search
CPC ..... E21B 10/602; E21B 10/32; E21B 10/46; E21B 34/06; E21B 3/00
See application file for complete search history.

(56) References Cited

U.S. PATENT DOCUMENTS

| | | | | |
|---|---|---|---|---|
| 9,121,223 | B2 * | 9/2015 | Niina | F16K 11/0746 |
| 10,180,058 | B2 * | 1/2019 | Carter | E21B 17/00 |
| 2008/0000693 | A1 | 1/2008 | Hutton | |
| 2012/0234604 | A1 | 9/2012 | Hall et al. | |
| 2015/0337601 | A1 | 11/2015 | Niina et al. | |
| 2016/0002978 | A1 * | 1/2016 | Rushton | E21B 7/06 175/61 |

* cited by examiner

VALVE MECHANISM FOR ROTARY STEERABLE TOOL AND METHODS OF USE

CROSS-REFERENCE TO RELATED APPLICATION

The present application is a U.S. National Stage Application of International Application No. PCT/US2016/043278 filed Jul. 21, 2016, which is incorporated herein by reference in its entirety for all purposes.

TECHNICAL FIELD

The present disclosure relates generally to subterranean drilling operations, and more particularly, to rotary steerable drilling tools for use with a drilling string in subterranean drilling operations.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation.

Many subterranean operations require drilling boreholes with vertically deviated and horizontal geometries. A technique for drilling horizontal, vertically deviated, and other complex boreholes is directional drilling. Directional drilling involves controlling, with an ability to vary, the direction of the wellbore as it is being drilled. Oftentimes the goal of directional drilling is to reach a position within a target subterranean destination or formation with the drilling string. For instance, the drilling direction may be controlled to direct the wellbore towards a desired target destination, to control the wellbore horizontally to maintain it within a desired payzone, or to correct for unwanted or undesired deviations from a desired or predetermined path.

Various options are available for providing steering capabilities to a drilling tool for controlling and varying the direction of the wellbore. For example, directional drilling may be accomplished with a "rotary steerable" drilling system wherein the entire drilling string is rotated from the surface, which in turn rotates the drill bit, connected to the end of the drilling string. In a rotary steerable drilling system, the drilling string may be rotated while the drilling tool is being steered either by being pointed ("point-the-bit") or pushed ("push-the-bit") in a desired direction (directly or indirectly) by a steering device.

In conventional "push-the-bit" systems, a pad or piston is extended from the drilling string to contact a portion of the wellbore. The pad or piston exerts a geosteering force to direct the drill bit in the desired drilling direction. As the entire drilling string generally rotates with the drill bit, it is necessary to synchronize a multitude of pads with the rotational motion of the drilling string. Rotary valves have been used to time the extension of a pad with the rotation of the drilling string.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
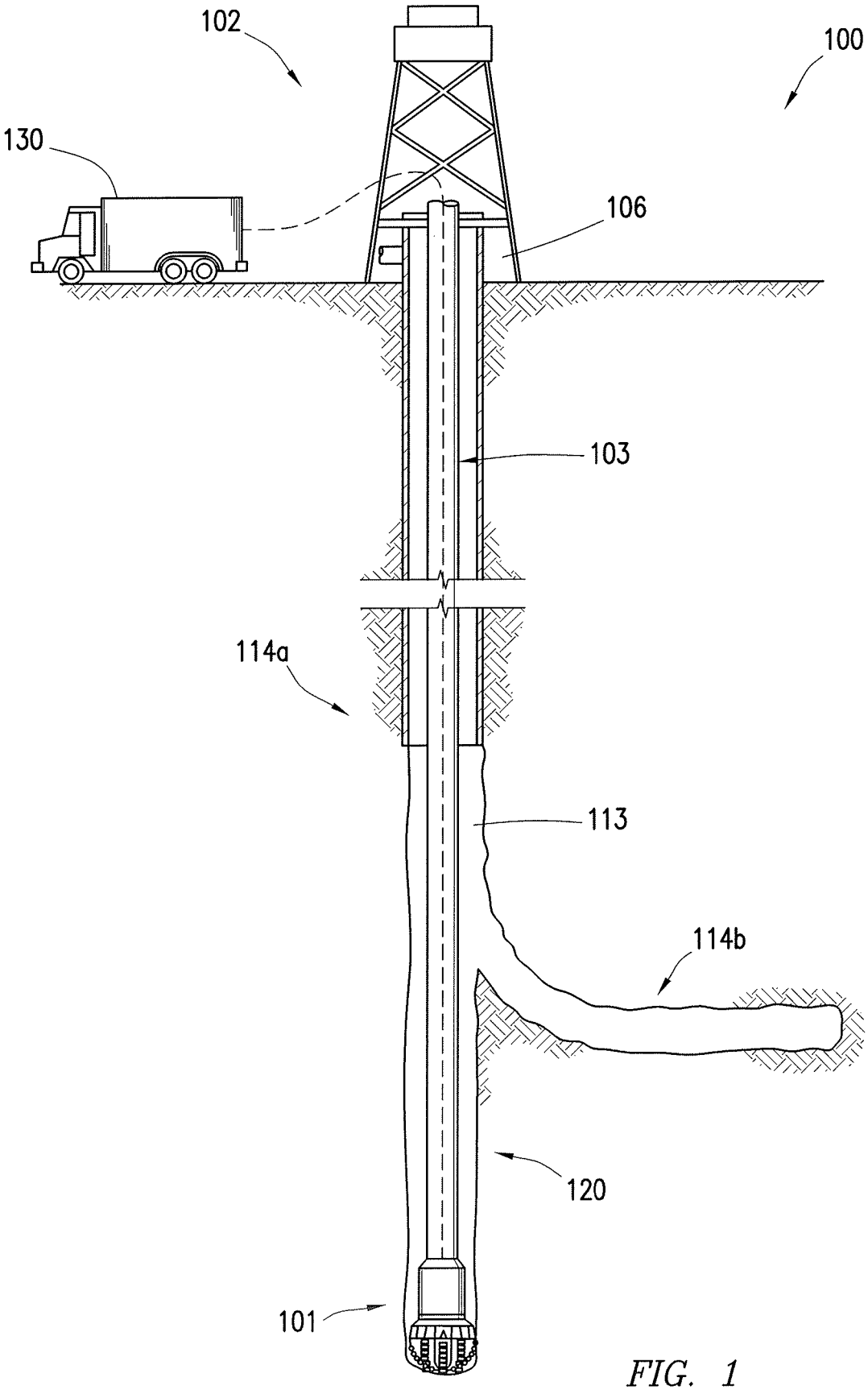
FIG. 1 is an elevation view of a directional drilling system in accordance with certain embodiments of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

The present invention relates generally to subterranean drilling operations, and more particularly, to rotary steerable drilling tools for use with a drilling string in subterranean drilling operations. A rotary steerable drilling system may be used with directional drilling systems for steering a drill bit to drill a non-vertical wellbore. These rotary steerable drilling systems generally fall into two classifications. In a "point-the-bit" system, the driveshaft connected to the drill bit is flexed to direct the drill bit in a desired direction. In a "push-the-bit" system, a force is asserted against the borehole to deflect the driveshaft and direct the drill bit in a desired direction.

A "push-the-bit" rotary steerable drilling system may comprise a plurality of movable steering pads mounted to a generally tubular drilling string. The steering pads may be selectively operated to contact a portion of a wellbore and deflect or bias the drill bit in a desired direction for directional drilling operations. The plurality of steering pads may be mounted on the outer circumference of the generally tubular drilling string. During drilling operations, the entire drilling string rotates along its axis to rotate the drill bit. Because the drilling string is constantly rotating, a mechanism is needed that synchronizes the actuation of the steering pads with the rotational motion of the drilling string so that the pads extend in the desired direction as the drilling string rotates. Rotary valves have been used to provide this synchronization. However, rotary valves used for similar operations are constantly moving and would thus be subjected to considerable wear and would be likely to fail over time. Failure of this rotary valve during drilling results in considerable lost time and resources as the drill string must be removed from the wellbore to replace the rotary valve. Thus, it is desirable to provide a mechanism to synchronize actuation of the steering pads that is robust and reliable for subterranean drilling operations. As would be appreciated by one having ordinary skill in the art with the benefit of the present disclosure, replacing the rotary valve used in earlier systems with gate valves is well suited to meet these needs. Gate valves are robust valves that are not prone to heavy wear or failure. Moreover, the systems and methods of the present disclosure provide a single actuator system that may be used to operate the gate valves without the need for complicated control systems and associated control algorithms to control multiple actuators.

The present disclosure may be understood with reference to FIGS. 1 through 4, where like numbers are used to indicate like and corresponding parts. FIG. 1 is an elevation view of a drilling system. Drilling system 100 may include a well surface or well site 106. Various types of drilling equipment such as a rotary table, drilling fluid pumps and drilling fluid tanks (not expressly shown) may be located at well surface or well site 106. For example, well site 106 may include drilling rig 102 that may have various characteristics and features associated with a land drilling rig. However, downhole drilling tools incorporating teachings of the present disclosure may be satisfactorily used with drilling equipment located on offshore platforms, drill ships, semi-submersibles, and/or drilling barges (not expressly shown).

Drilling system 100 may include drilling string 103 coupled to drill bit 101 that is rotated about its axis to form a wide variety of wellbores or bore holes such as generally vertical wellbore 114*a* or generally horizontal wellbore 114*b* or any combination thereof. Various directional drilling techniques and associated components of drilling tool 120 of drilling string 103 may be used to form horizontal wellbore 114*b*. For example, lateral forces may be applied to drilling tool 120 proximate kickoff location 113 to form generally horizontal wellbore 114*b* extending from generally vertical wellbore 114*a*. The term directional drilling may be used to describe drilling a wellbore or portions of a wellbore that extend at a desired angle or angles relative to vertical. Such angles may be greater than normal variations associated with vertical wellbores. Directional drilling may include horizontal drilling. Drilling system 100 may comprise a control station 130 for controlling drilling tool 120. Control station 130 may be communicatively coupled to drilling tool 120. Control station 130 may be permanently installed at the well site. Alternatively, control station 130 may be mounted to a mobile trailer for easy transport to and from the well site. Control station 130 may be used to send or receive signals from one or more downhole sensors (not explicitly shown). Control station 130 may be used to control at least the direction, speed, and angle of drilling.

Figure 2:
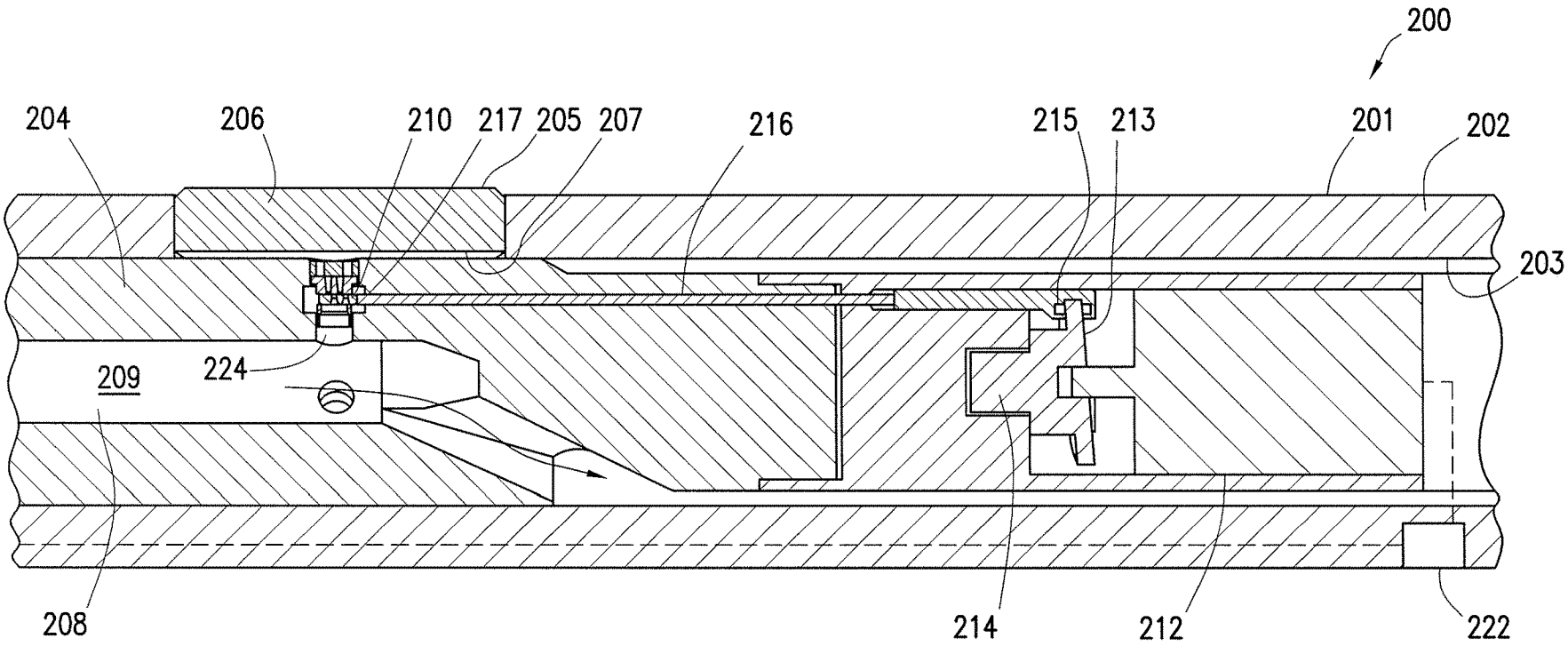
FIG. 2 is a cross sectional view of an embodiment of a rotary steerable drilling tool in accordance with certain embodiments of the present disclosure.

FIG. 2 is a cross sectional view of a rotary steerable drilling tool 200 in accordance with the present disclosure. Drilling tool 200 comprises a first tubular member 202. First tubular member 202 may be a drilling string. First tubular member 202 may comprise any suitable metal or other material formed to have an outer circumference 201 and an inner circumference 203. A second tubular member 204 may be disposed within a region defined by inner circumference 203 of first tubular member 202. Second tubular member 204 may be a housing. Second tubular member 204 may be configured to support other components of drilling tool 200. A plurality of moveable steering pads 206 are mounted to first tubular member 202. In an unextended position, steering pads 206 may partially or fully penetrate a portion of outer circumference 201 of first tubular member 202. Alternatively, steering pads 206 may be disposed along and mounted directly to outer circumference 201 of first tubular member 202. Drilling tool 200 may comprise three movable steering pads mounted to outer circumference 201 of first tubular member 202 at 120° intervals. As those of ordinary skill in the art having the benefit of the present disclosure will appreciate, any number of steering pads may be mounted along or within outer circumference 201 of first tubular member 202. Steering pads 206 may comprise an exterior surface 205 and an interior surface 207. Steering pads 206 are capable of moving outward in the radial direction so as to allow exterior surface 205 to make contact with at least a portion of a wellbore (not shown). Steering pads 206 are capable of being selectively actuated to extend outward in the radial direction or retract inward in the radial direction. Steering pads 206 may be selectively actuated by applying a force to interior surface 203 in a radially outward direction. Steering pads 206 may be selectively actuated hydraulically, mechanically, electrically, electromagnetically, or in any other suitable manner.

Second tubular member 204 may comprise a single unibody construction or it may comprise multiple manufactured pieces. The multiple manufactured pieces may be coupled together to form second tubular member 204 or they may be held together by other components of drilling tool 200. Second tubular member 204 may further comprise an interior annulus 208. Interior annulus 208 may contain a high pressure fluid 209 flowing throw interior annulus 208. Steering pads 206 may be hydraulically actuated by high pressure fluid 209. High pressure fluid 209 may comprise any pressurized fluid having a higher pressure than the fluid of the wellbore that is suitable for wellbore treatment operations. Second tubular member 204 may further comprise a plurality of gate valves 210 corresponding to the plurality of steering pads 206. Each gate valve 210 may be disposed within a fluid channel 224 extending radially through second tubular member 204 to connect interior annulus 208 with interior surface 207 of steering pad 206. Each gate valve 210 may be disposed adjacent to the corresponding one of the plurality of steering pads 206. Fluid channel 224 may be a hollow path through second tubular member 204 creating a fluid path between interior annulus 208 and interior surface 207 of steering pad 206. Gate valves 210 may be selectively operable to hydraulically actuate steering pads 206. In a closed position, gate valve 210 isolates interior surface 207 of steering pad 206 from high pressure fluid 209. In an open position, gate valve 210 exposes interior surface 207 of steering pad 206 to high pressure fluid 209 by creating a fluid path between interior surface 207 and interior annulus 208 of second tubular member 204. Gate valve 210 may create this fluid path by opening a plurality of ports 211 corresponding to the plurality of steering pads 206. Gate valve 210 may be selectively operated to extend steering pad 206 by opening a corresponding port 211. Gate valve 210 may be selectively operated to retract steering pad 206 by closing a corresponding port 211.

The gate valves 210 may be selectively operated by rotary motor 212 disposed within second tubular member 204. Rotary motor 212 may be coupled to a swash plate 214. Swash plate 214 may be a generally circular disk that is disposed within second tubular member 204. Swash plate 214 may comprise a slanted face 213 that is at an angle that is not perpendicular to the longitudinal axis of first tubular member 202. As rotary motor 212 rotates swash plate 214, slanted face 213 also rotates along its axis, varying the angle at which swash plate 214 sits relative to a perpendicular axis of first tubular member 202. A plurality of drive rods 216 corresponding to the plurality of gate valves 210 may be disposed within a portion of second tubular member 204. Drive rods 216 may be positioned so that they run parallel to the longitudinal axis of first tubular member 202. Each drive rod 216 may comprise a first end 215 and a second end 217. Swash plate 214 may be longitudinally coupled to a first end 215 of a plurality of drive rods 216 such that swash plate 214 may rotate freely. As swash plate 214 rotates, the angle of slanted face 213 causes drive rods 216 to move longitudinally along with the relative position of slanted face 213. A second end 217 of the drive rods 216 may be further coupled to gate valves 210. Rotary motor 212 may selectively operate the gate valves 210 by rotating the swash plate 214. As swash plate 214 rotates, the drive rods 216 move back and forth along a longitudinal axis to slide gate valves 210 between their open and closed positions.

One or more downhole sensors 222 may be used for providing information about the drilling operation. The one or more sensors 222 may be communicatively coupled to control station 130. Control station 130 may be used to directionally steer the drilling tool. Control station 130 may be located at an uphole location as depicted in FIG. 1. The information provided by the sensors may be locational information related to the drilling tool, operating data, data relating to wellbore conditions, or any other data useful for directional drilling operations. The one or more sensors 222 may be telemetry sensors.

Figure 3:
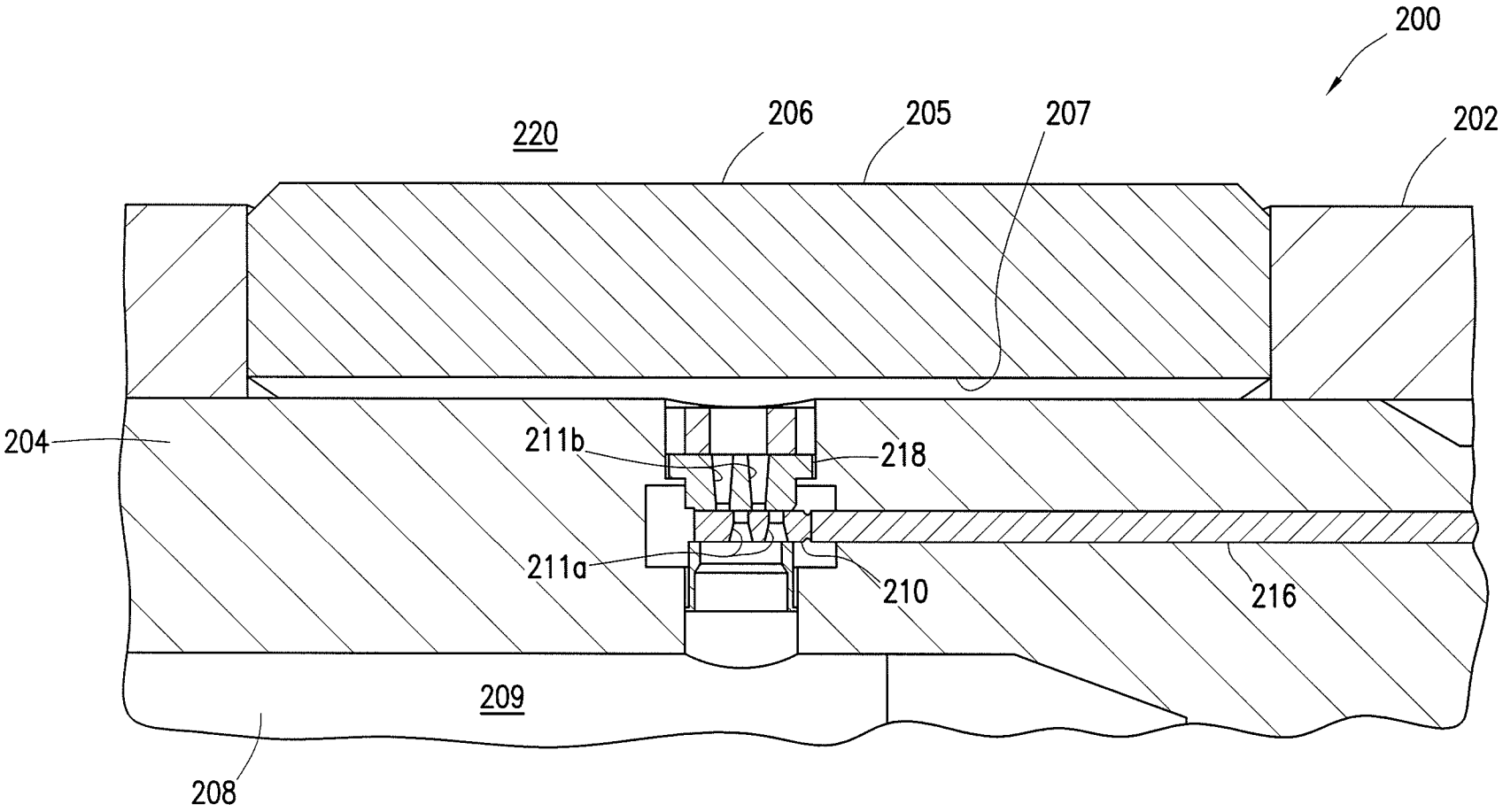
FIG. 3 is a close-up cross sectional view of a portion of an embodiment of a rotary steerable drilling tool shown with a steering pad in a retracted position in accordance with certain embodiments of the present disclosure.

Referring now to FIG. 3, a close-up cross sectional view of a portion of drilling tool 200 is shown with steering pad 206 in its retracted position. Gate valve 210 is shown in its closed position. In this closed position, gate valve 210 fluidically disconnects interior annulus 208 and interior surface 207 of steering pad 206. Gate valve 210 comprises gate ports 211*a* that correspond with seat ports 211*b* located through valve seat 218. Valve seat 218 creates a fluid tight seal between interior annulus 208 and interior face 203 of steering pad 206. In this closed position, swash plate 214 may be rotated such that driving rod 216 has been pulled away from channel 224. With driving rod 216 pulled away from channel 224, gate ports 211*a* are not aligned with seat ports 211*b*, and interior surface 207 of steering pad 206 is not exposed to high pressure fluid 209 from interior annulus 208 of second tubular member 204. Lower pressure fluid 220 from the annulus of the wellbore exerts a biasing force against the outer surface 205 of steering pad 206, biasing it inward in a radial direction.

Figure 4:
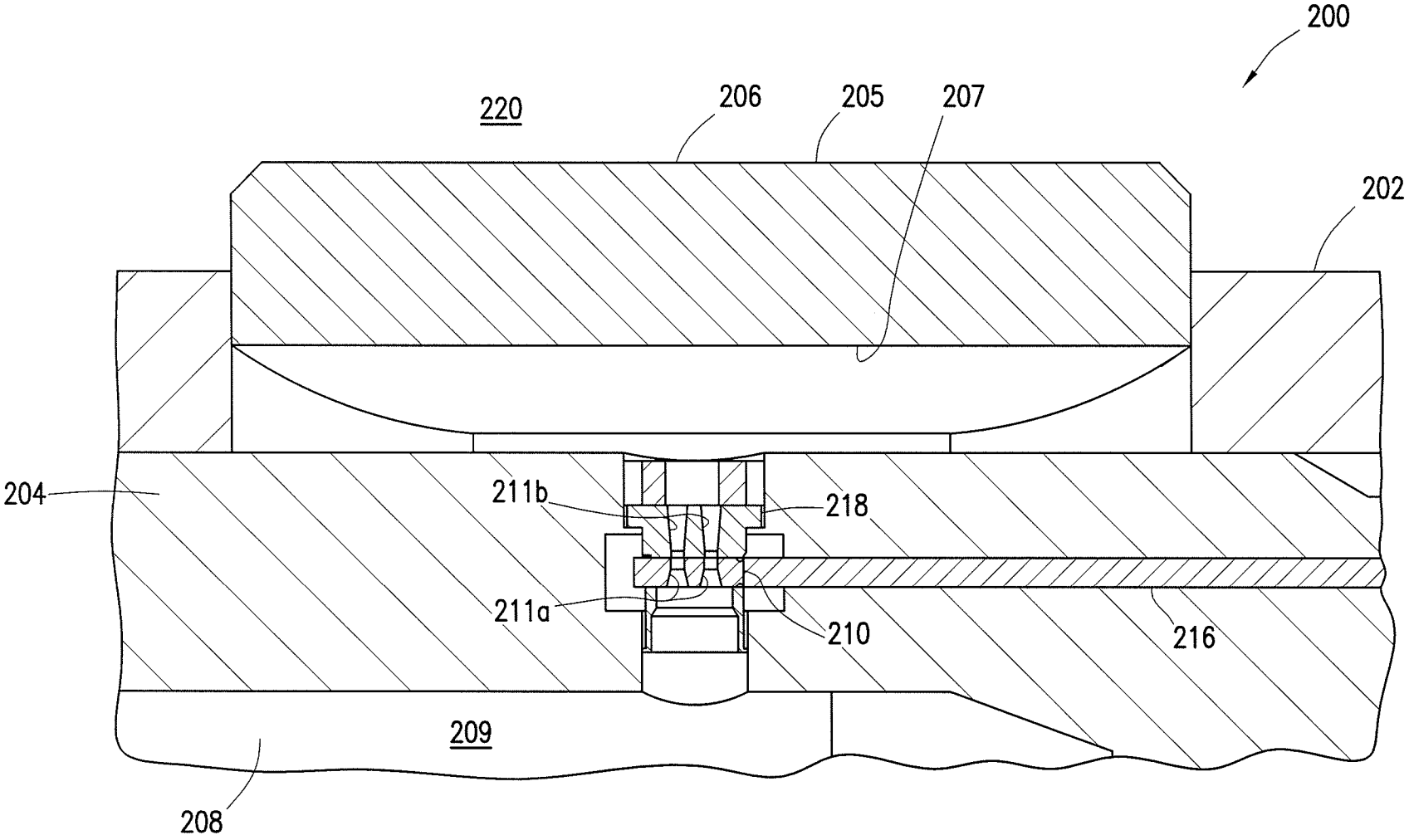
FIG. 4 is a close-up cross sectional view of a portion of an embodiment of a rotary steerable drilling tool shown with a steering pad in an extended position in accordance with certain embodiments of the present disclosure.

Referring now to FIG. 4, a close-up cross sectional view of the same portion of drilling tool 200 is shown with steering pad 206 in its extended and hydraulically actuated position. Gate valve 210 is shown in its open position. In this open position, gate valve 210 fluidically connects the interior annulus 208 with the corresponding interior surface 207 of steering pad 206. Rotary motor 212 has rotated swash plate 214 so that the angle of slanted face 213 has pushed driving rod 216 longitudinally towards channel 224. Gate ports 211*a* are now aligned with seat ports 211*b*, exposing interior surface 207 of steering pad 206 to high pressure fluid 209 from interior annulus 208 of second tubular member 204. High pressure fluid 209 comprises a pressure that is higher than that of low pressure fluid 220. High pressure fluid 209 thus may exert a force against interior surface 207 of steering pad 206 sufficient to overcome the biasing force exerted against outer surface 205 of steering pad 206 by low pressure fluid 220, thereby pushing steering pad 206 outward in a radial direction. Outer surface 205 of steering pad 206 is then capable of contacting at least a portion of the wellbore to deflect the drilling tool 200 away from the portion of the wellbore.

The rotary motor is used to selectively and hydraulically actuate the plurality of steering pads to deflect the drilling tool away from a portion of the wellbore, thereby enabling directional drilling. The rotary motor may be an electric motor, hydraulic motor, or any other type of motor suitable to selectively operate the steering pads. The rotary motor may rotate in an opposite direction than that of the drilling string and drill bit. The rotation of the rotary motor must be synchronized with the rotational motion of the drilling string to sequentially extend the steering pads in a geostationary fashion. The rotational speed of the rotary motor may be varied to synchronize the rotation of the rotary motor and the drilling string. Synchronizing the rotational speed of the rotary motor in this fashion allows each steering pad to extend and retract at the same relative rotational position as the drilling string itself rotates. The rotational speed of the rotary motor may be varied in the range of from about 30 rpm to about 150 rpm. The rotary motor may be coupled to a variable-frequency drive to vary the rotational speed of the rotary motor.

In certain embodiments, it may be desirable to continuously alter the direction of directional drilling so as to drill through several different desired locations within a subterranean formation. The rotational speed of the rotary motor may be controlled so as to change the direction of drilling from one direction to another. In certain embodiments, the rotational speed of the rotary motor may be briefly unsynchronized with the rotational motion of the drilling string to establish a new direction for sequential extension of the steering pads. The rotation of the rotary motor may then be resynchronized with the drilling string so that the steering pads extend in the desired direction. In certain embodiments, the rotational speed of the rotary motor may be slightly varied to slowly shift the direction in which the steering pads are extended. As would be appreciated by one of ordinary skill in the art having the benefit of the present disclosure, these changes and shifts may be accomplished manually or automatically using a control system for the rotary steerable drilling system.

As would be appreciated by one having ordinary skill in the art with the benefit of the present disclosure, the systems and methods of the present disclosure are suitable for use with any number of steering pads mounted to the drilling string of the drilling tool. In certain embodiments, three movable steering pads are mounted to the drilling string at 120° intervals. This allows the rotary motor to efficiently control the steering pads by rotating the swash pate along the full range of its 360° rotational path. At any given point along its rotational path, the gate valves and corresponding ports are sized so that one steering pad is extended while the other two pads are retracted. As the swash plate rotates, the drive rod slides along a longitudinal access to align the corresponding ports and hydraulically actuate the steering pad. As the swash plate continues to rotate, the swash plate pulls the drive rod along the longitudinal access to close the gate valve by moving the ports out of alignment. By continuously rotating the swash plate, the gate valves may be synchronously operated to sequentially extend the steering plates such that each steering pad extends at the same relative rotational position as the drilling string rotates. This allows a nearly continuous force to be exerted against the portion of the wellbore that deflects the drilling tool in the desired drilling direction.

An embodiment of the present disclosure is a rotary steerable tool comprising a first tubular member; a plurality of steering pads mounted to the first tubular member; a second tubular member coaxially disposed within the first tubular member; a plurality of gate valves disposed within the second tubular member, each gate valve being disposed adjacent to a corresponding steering pad; and a rotary motor disposed within the second tubular member coupled to the plurality of gate valves.

Another embodiment of the present disclosure is a method of steering a drilling tool comprising rotating a drill string coupled to a drill bit about its axis to form a wellbore; controlling a rotary motor disposed within the drill string to selectively open and close one or more of a plurality of gate valves to hydraulically actuate a corresponding one or more plurality of steering pads by, in an open position, allowing pressurized fluid to contact corresponding interior surfaces of the corresponding one or more plurality of steering pads to push the one or more plurality of steering pads into contact with a portion of the wellbore to deflect the drill bit away from the portion of the wellbore.

Another embodiment of the present disclosure is a rotary steerable tool comprising a tubular member; a plurality of steering pads mounted to and around an outer circumference of the tubular member at equidistant intervals; a plurality of gate valves corresponding, and disposed adjacent, to the plurality of steering pads; a rotary motor; a swash plate coupled to the rotary motor; and a plurality of drive rods, each having a first end coupled to the swash plate and a second end coupled to a corresponding gate valve.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee.

What is claimed is:

1. A rotary steerable tool comprising:

a first tubular member;

a plurality of steering pads mounted to the first tubular member;

a second tubular member coaxially disposed within the first tubular member;

a plurality of gate valves disposed within the second tubular member, each gate valve being disposed adjacent to and along the same radial direction as a corresponding steering pad; and a rotary motor disposed within the second tubular member coupled to the plurality of gate valves.

2. The rotary steerable tool of claim 1, further comprising a swash plate disposed within the second tubular member and coupled to the rotary motor and the plurality of gate valves.

3. The rotary steerable tool of claim 2, further comprising a plurality of drive rods disposed within the second tubular member, each drive rod having a first end and a second end, wherein:

the first end is coupled to the swash plate; and the second end is coupled to a corresponding one of the plurality of gate valves.

4. The rotary steerable tool of claim 1, further comprising one or more downhole sensors communicatively coupled to the rotary motor.

5. The rotary steerable tool of claim 4, wherein the one or more downhole sensors comprise telemetry sensors.

6. The rotary steerable tool of claim 1, further comprising a variable-frequency drive coupled to the rotary motor.

7. The rotary steerable tool of claim 1, wherein the second tubular member further comprises a plurality of ports corresponding to the plurality of gate valves to allow fluid communication between an interior annulus of the second tubular member and at least an interior surface of the steering pads.

8. The rotary steerable tool of claim 1, wherein each of the plurality of gate valves further comprises a plurality of gate ports and a valve seat having a corresponding plurality of gate ports, the gate ports of the gate valve being aligned with the gate ports of the valve seat when the gate valve is in an open position.

9. A method of steering a drilling tool comprising:

rotating a drill string coupled to a drill bit about an axis of the drill string to form a wellbore;

controlling a rotary motor disposed within the drill string to selectively open and close one or more of a plurality of gate valves to hydraulically actuate a corresponding one or more plurality of steering pads by, in an open position, allowing pressurized fluid to flow from an interior annulus into contact with corresponding interior surfaces of the corresponding one or more plurality of steering pads to push the one or more plurality of steering pads into contact with a portion of the wellbore to deflect the drill bit away from the portion of the wellbore, each gate valve being disposed adjacent to and along the same radial direction as a corresponding steering pad.

10. The method of claim 9, wherein controlling the rotary motor further comprises:

receiving one or more signals indicative of an operational parameter of the rotary motor from one or more downhole sensors coupled to the rotary motor at an uphole control station; and based at least in part on the one or more signals received from the one or more downhole sensors and preset data indicative of a desired direction of steering the drilling tool, varying a rotational speed of the rotary motor to synchronize the actuation of the plurality of movable steering pads to direct the drilling tool into the desired direction of drilling.

11. The method of claim 10, further comprising operating the rotary motor at a rotational speed in a range of from about 30 rpm to about 150 rpm.

12. The method of claim 10, further comprising receiving the one or more signals from one or more telemetry sensors.

13. The method of claim 9, wherein controlling the rotary motor further comprises rotating the rotary motor in a rotational direction opposite the drill bit.

14. The method of claim 9, further comprising:

rotating a swash plate coupled to the rotary motor; and longitudinally oscillating a plurality of drive rods, each drive rod having a first end coupled to the swash plate and a second end coupled to a corresponding gate valve.

15. The method of claim 9, wherein selectively operating the plurality of gate valves further comprises opening or closing the gate valves to fluidically connect or disconnect the interior annulus of the drill string with the corresponding interior surfaces of the one or more steering pads.

16. The method of claim 9, wherein hydraulically actuating the plurality of movable steering pads further comprises hydraulically actuating three movable steering pads placed at 120° intervals along an outer circumference of the drilling tool.

17. The method of claim 9, further comprising extending the plurality of movable steering pads when the corresponding plurality of gate valves are in an open position and retracting the plurality of movable steering pads when the corresponding plurality of gate valves are in a closed position.

18. A rotary steerable tool comprising:

a tubular member;

a plurality of steering pads mounted to and around an outer circumference of the tubular member at equidistant intervals;

a plurality of gate valves corresponding to and disposed adjacent to and along the same radial direction as the plurality of steering pads;

a rotary motor;

a swash plate coupled to the rotary motor; and a plurality of drive rods, each having a first end coupled to the swash plate and a second end coupled to a corresponding gate valve.

19. The rotary steerable tool of claim 18, wherein each of the plurality of gate valves further comprises a plurality of gate ports and a valve seat having a corresponding plurality of gate ports, the gate ports of the gate valve being aligned with the gate ports of the valve seat when the gate valve is in an open position.

20. The rotary steerable tool of claim 18, further comprising one or more downhole sensors communicatively coupled to at least one of an uphole location and the rotary motor.

* * * * *